United States Patent [19]

Langston, Jr. et al.

[11] 4,369,914

[45] Jan. 25, 1983

[54] BOX TYPE CARTON WITH HINGED LID

[75] Inventors: Joseph Langston, Jr., Jacksonville, Fla.; Robert J. Murray, Norcross, Ga.

[73] Assignee: Federal Paper Board Company, Inc., Montvale, N.J.

[21] Appl. No.: 270,594

[22] Filed: Jun. 4, 1981

[51] Int. Cl.[3] ..... B65D 5/64; B65D 5/56

[52] U.S. Cl. ..... 229/33; 229/44 R

[58] Field of Search ..... 229/33, 32, 44 R; 220/441, 443

[56] References Cited

U.S. PATENT DOCUMENTS

| | | | |
|---|---|---|---|
| 2,619,276 | 11/1952 | Gibbons | 229/33 |
| 3,469,765 | 9/1969 | Mueller | 229/33 |
| 3,643,856 | 2/1972 | Jones | 220/441 |
| 3,910,482 | 10/1975 | Bamburg | 220/443 |
| 4,144,996 | 3/1979 | Kuckenbecker | 229/33 |

FOREIGN PATENT DOCUMENTS

| | | | |
|---|---|---|---|
| 581832 | 10/1924 | France | 229/33 |
| 1412559 | 8/1965 | France | 229/33 |
| 1493047 | 7/1967 | France | 229/33 |
| 714466 | 8/1954 | United Kingdom | 229/33 |
| 1415705 | 11/1975 | United Kingdom | 229/33 |

*Primary Examiner*—Herbert F. Ross

*Attorney, Agent, or Firm*—FitzGibbon, Roehrig, Greenawalt & Stone

[57] ABSTRACT

A box with a hinged lid is formed from a single sheet of cut and scored paperboard, the box being in the form of a tray having front, back and end walls and a lid which are reinforced by multiple plies of material so as to increase their rigidity, with a substantial thickness at the top edge of the front wall on which the lid is adapted to rest when closed, and with certain of the walls being reinforced by inserts, and the hinge structure joining the back wall and the multi-ply lid being such that the lid tends to close but may be readily held in an open position so as to permit access to the body of the box which is filled with a product such as cigars or similar products.

6 Claims, 9 Drawing Figures

FIG. 1
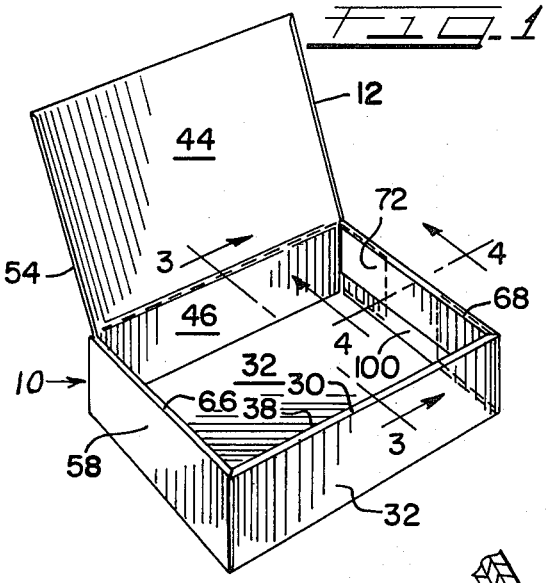
FIG. 2
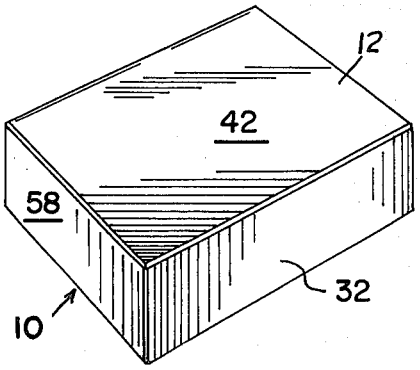
FIG. 3
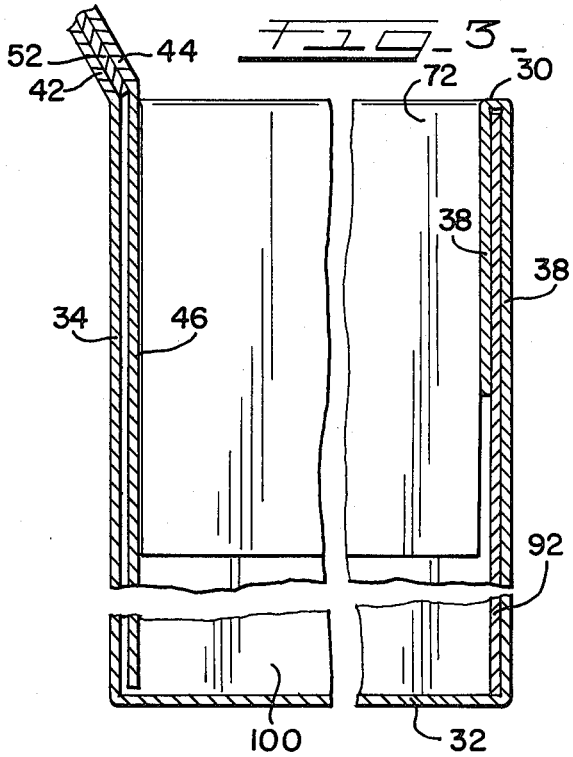
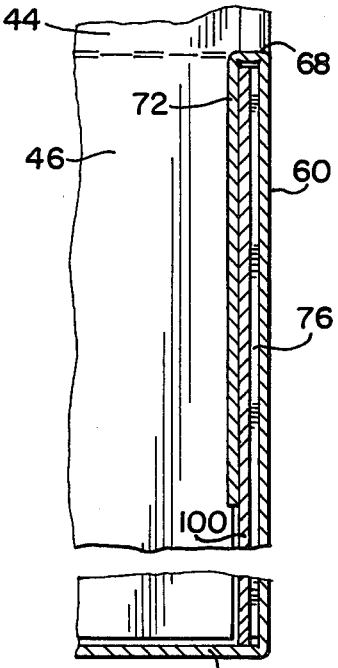
FIG. 4
FIG. 6
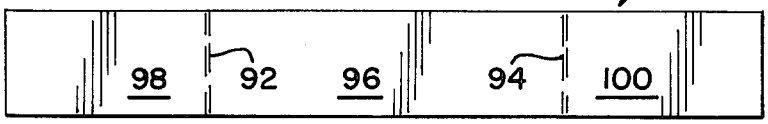

FIG. 7
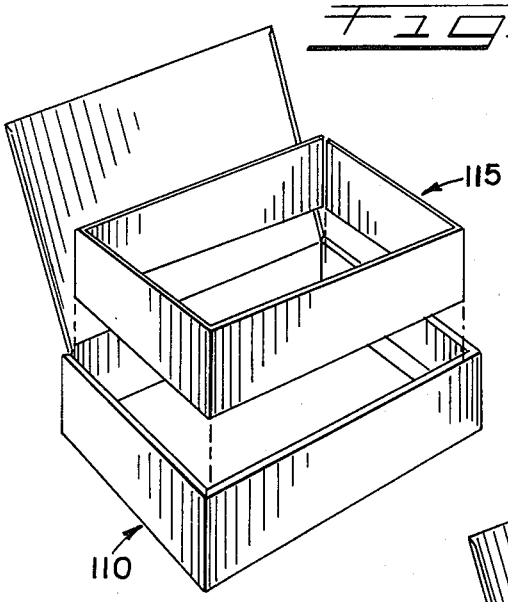
FIG. 8
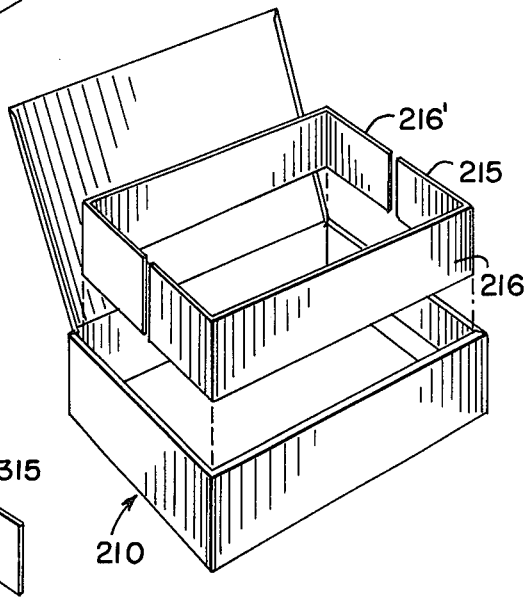
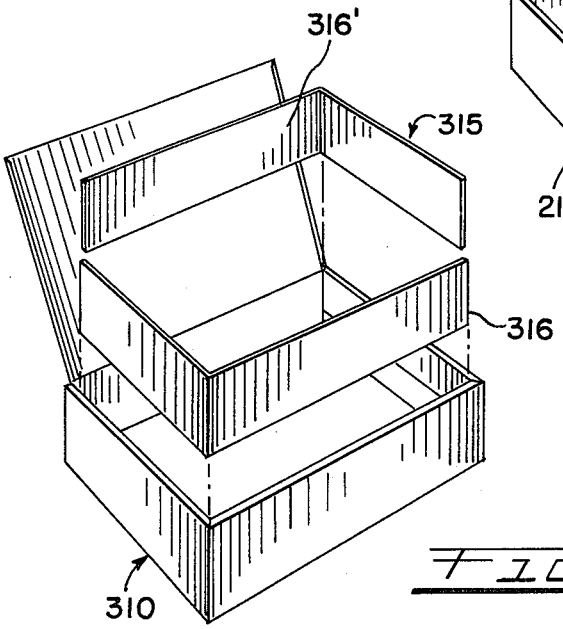
FIG. 9

BOX TYPE CARTON WITH HINGED LID

BACKGROUND OF THE INVENTION

This invention relates to containers and is more particularly concerned with improvements in a receptacle which may be formed of paperboard and employed particularly for containing cigars or similar products.

Conventional containers for cigars have for many years been made of wood with a tray like bottom in which the cigars are positioned and a hinged cover, or lid, which may be held open to permit ready access to the contents of the tray. For economical reasons, many efforts have been made recently to develop a paperboard box which would have the form of the conventional wooden box for cigar products. While the designs which have been developed for such purpose have simulated the conventional wooden cigar boxes they have not been widely accepted commercially for a number of reasons, principly, because of a lack of rigidity in the walls and the failure to provide a blank which could be partially constructed for delivery to the packer in flattened condition and which would require only relatively simple machinery for set-up at the point of use.

It is a general object of the present invention to provide a paperboard box which embodies the essential features of conventional wooden cigar boxes and which can be economically manufactured from a printed blank so as to simulate such boxes when set-up and which is readily adapted for set-up at the packer or manufacturing sight of the product to be marketed in the same.

It is a more particular object of the invention to provide a container in the form of a tray and a cover therefor which are made primarily from a one piece blank of a foldable sheet material, such as paperboard, and which may be set-up by the product manufacturer with simple machinery so as to obviate the need for shipping to the user containers which have been previously set-up and require substantial shipping and storage space.

It is a more specific object of the invention to provide a paperboard container for cigars, or like products, which can be economically manufactured and printed so as to simulate the wood boxes heretofore used by the cigar manufacturers.

It is another object of the invention to provide a container which is in the form of a tray with a hinged cover and which can be manufactured from a single one piece blank of foldable material, such as, paperboard, with the tray having a bottom wall, a pair of spaced side walls which extend upwardly from the bottom wall and are generally normal thereto, a rear wall and a front wall spaced from the rear wall with a lid or cover hinged to the rear wall and adapted to rest, when closed, on the top edge of the front wall and with certain of the walls being reinforced by inserts so as to provide adequate rigidity for protecting the contents during shipment and handling.

It is a further object of the invention to provide a container in the form of a tray with a planar lid hinged to a back wall thereof which is reinforced with multiple plys of the material and which tends to close when freed to do so but which may be readily held open to display the contents of the container.

The invention which is disclosed and claimed comprises a tray-like container with a planar lid hinged to the back wall which is formed from foldable sheet material, such as, paperboard, or the like, and which has certain of the walls stiffened by a reinforcing strip which is secured between inner and outer panels forming the walls of the tray.

The foregoing and other objects and advantages of the invention will be more apparent upon consideration of the preferred forms of the tray construction which are illustrated in the accompanying drawings wherein like parts are identified by the same numerals throughout the views.

BRIEF DESCRIPTION OF THE DRAWINGS

FIG. 1 is a perspective view of a box constructed in accordance with the invention, the cover or lid of the box being shown in partly open condition;

FIG. 2 is a view similar to FIG. 1 with the box shown in the closed condition;

FIG. 3 is a cross sectional view taken on the line 3—3 of FIG. 1, to a greatly enlarged scale and with portions broken away;

FIG. 4 is a longitudinal sectional view taken on the line 4—4 of FIG. 1, to a greatly enlarged scale, and with portions thereof broken away;

FIG. 6 is a plan view showing the blank which is employed as a wall reinforcing insert in the box of FIG. 1; and FIGS. 7, 8 and 9 show exploded perspective views of a box employing modified forms of the insert forming strip material which may be employed in reinforcing the front, back and end walls of the box.

DESCRIPTION OF THE PREFERRED EMBODIMENT OF THE INVENTION

Figure 5:
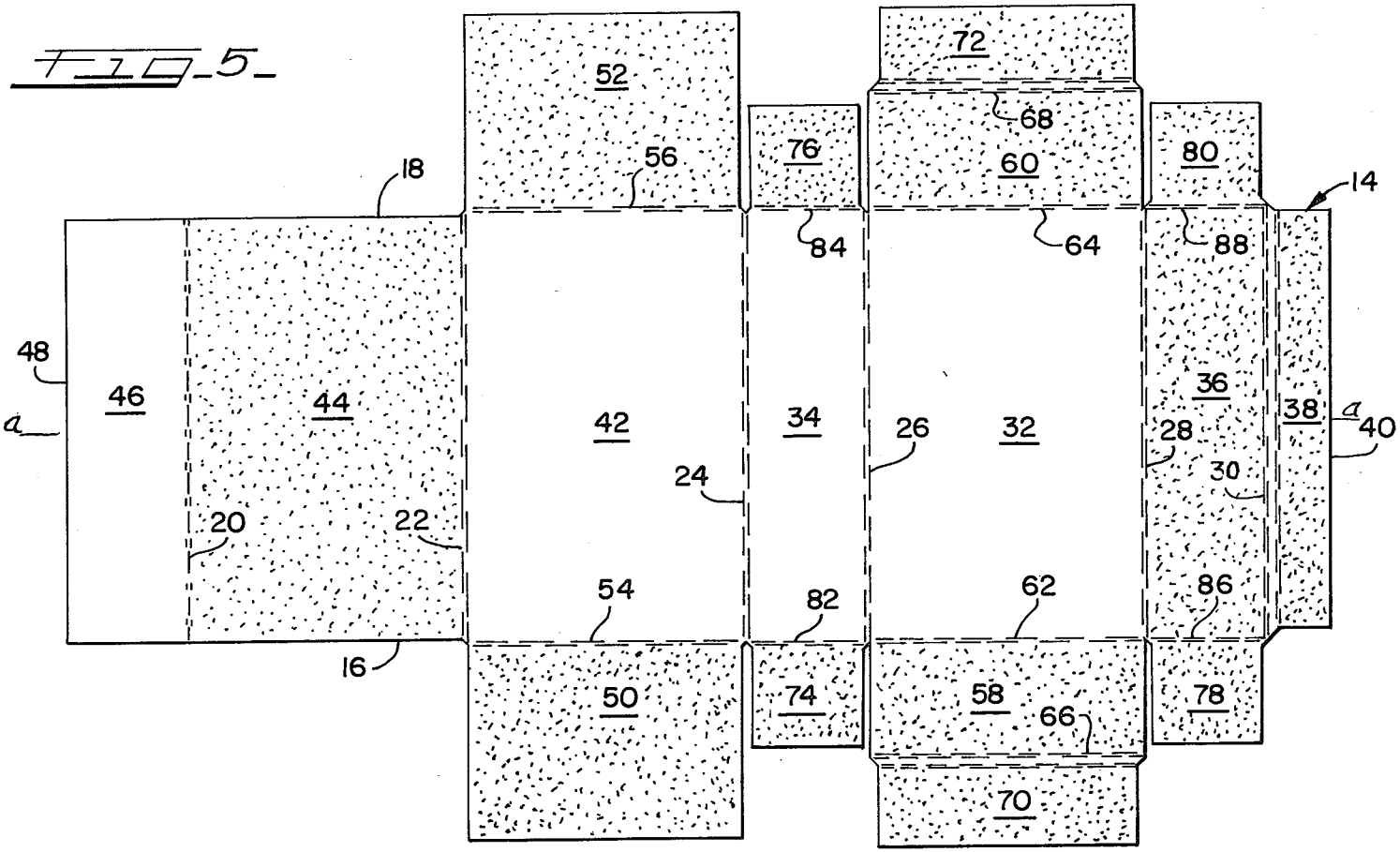
FIG. 5 is a plan view of the inside face of a blank which is cut and scored to form the box of FIG. 1.

Referring to FIG. 1 of the drawings there is illustrated a paperboard box 10 which is especially adapted for the marketing of cigars in the conventional manner, the box having a hinged lid 12 and simulating the conventional wooden cigar box. The box 10 is formed primarily from a single sheet or blank 14 of relatively light weight foldable paperboard (FIG. 5) and a foldable reinforcing insert panel 15 (FIG. 6) of relatively thick paperboard is employed to stiffen and rigidify the front and end walls of the same.

The blank 14 which is formed from a sheet of paperboard of a weight or gauge frequently used in the manufacture of small cartons is cut and scored as shown in FIG. 5. The blank 14 is generally elongate and is symmetrical about the longitudinal center line a—a. The center portion of the blank between the parallel, spaced, longitudinal, lines 16 and 18, which are cut and scored in part, is divided by parallel, longitudinally spaced, transverse score lines 20, 22, 24, 26, 28 and 30 to divide the same into a rectangular bottom wall forming panel 32, adjoining back and front wall outer panels 34 and 36 which are separated therefrom by score lines 26 and 28, respectively, and which are if equal dimensions. An inside front wall panel 38 of somewhat smaller width than panel 36 extends from the closely spaced double score lines 30 to the end edge 40 of the blank. At the other end of the blank an outside lid panel 42 extends between the score lines 22 and 24 and is separated from the back wall panel 34 by the hinge-score line 24. The panel 42 is substantially the same size as panel 32. An inside lid panel 44 extends between the score line 20 and the score line 22 which is substantially the same dimensions as the outside lid panel 42. An inner back wall panel 46 extends from the score line 20 to the end edge 48 of the blank which is of slightly smaller dimensions than the back wall panel 34. The outside lid panel 42 has side panels 50 and 52 of approximately half the dimensions of the panel 42 extending outboard of the side edge lines 16 and 18, the dividing portions 54 and 56 of which are score lines. The bottom wall forming panels 32 has outer side wall or end wall panels 58 and 60 extending outboard of the scored portions 62 and 64 of the edge lines 16 and 18 which have a transverse dimension corresponding to the dimensions of the panels 34 and 36 in the lengthwise direction of the blank and each of the panels 58 and 60 has separated therefrom, by longitudinal, parallel, double score lines 66 and 68, end wall inside panels 70 and 72 which have a transverse dimension somewhat less than the outside end wall panels 58 and 60 and a dimension somewhat less, in the longitudinal direction, than the outside panels 58 and 60. The score lines in the double score lines 66 and 68 are relatively close together but spaced sufficiently to accomodate a reinforcing member hereinafter described. The front and back wall outside panels 34 and 36 have outboard corner connecting flaps 74, 76 and 78, 80 extending from score portions 82, 84 and 86, 88 of the side lines 16 and 18. The flaps 74, 76 and 78, 80 have a transverse dimension slightly less than the corresponding dimension of the end wall panels 58 and 60. These panels are separated from the adjoining panels 50, 52 and 58, 60 by narrow slots to allow for folding without interference or binding.

The wall reinforcing blank or strip 16, which is illustrated in FIG. 6, may be substantially heavier gauge paperboard than the blank 14. It has a width slightly less than the corresponding dimension of the wall panels 36, 58 and 60 in FIG. 5 and a predetermined length somewhat less than the overall length of the panels 36, 58 and 60 in the blank 14. The wall reinforcing blank 16 is divided by parallel transverse score lines 92 and 94 into three panels 96, 98 and 100. The panel 96 has a width and length slightly less than corresponding dimensions of the front wall forming panel 36 in the blank 14 while the dimensions of the two end panels 98 and 100 are slightly less than the corresponding dimensions of the end wall panels 58 and 60 in the blank 14.

The blank 14 may be furnished in the flat by the manufacturer for shipment to the product manufacturer where glue may be applied to the panels 36, 38, 44, 50, 52, 58, 70, 60, 72, 74, 76, 78 and 80, as indicated in FIG. 5. The insert panel 16 may be applied to panels 36, 78 and 80 and the panels folded to set up the box with the wall reinforcing insert panel 15 secured to the inside faces of the front side and end wall panels 36, 58 and 60 as the latter are erected and the front and back walls tabs or panels 74, 76 and 78, 80 with the inside panels 38, 70 and 72 being secured to the inside faces of the reinforcing panels 96, 98 and 100 as shown in FIGS. 1, 3 and 4. The lid 12 is formed by folding and adhesively securing the reinforcing panels 50 and 52 between the outer and inner lid panels 42 and 44. The inner back panel 46 may be left free to slide up and down on the inside face of the back wall panel 34 to permit free operation of the hinge joint at 24 in opening and closing the lid 12. The width of the top edge of the front wall assembly will be sufficient, due to the double score 30 and the increased thickness resulting from the presence of the insert panel 96, to enable a small nail to be used for holding the lid 12 in closed position in the same manner as long employed in the conventional wooden cigar box.

It may be found desirable to provide a different reinforcing arrangement for the vertical walls of the box which will further strengthen and rigidify the body of the box, including particularly, the back wall to the top edge of which the lid is hinged. Also a different arrangement of the wall reinforcing insert may be found desirable in the design of machinery for handling the main blank and the insert and setting up the box in its completed form. In FIGS. 7, 8 and 9 modified arrangements for the reinforcing insert are illustrated. In FIG. 7 the box 110 is formed from a single blank of the same character as the blank 14 in FIG. 5 with a wall insert 115 which is in the form of a blank of reinforcing strip material which may be the same or similar material as the insert 15. The insert 115 is formed from a blank which is scored so as to divide it into four panels of a size which will fit in face engaging relation against the inside faces of the four vertical walls of the box body with a meeting point, for the ends of the strip, at one of the four corners. Preferably, the outside faces of the four wall reinforcing panels will be adhesively secured to the inside faces of the outer wall panels of the box body with the top margins of the three panels against the front and end walls overlapped by the inner wall panels in the same manner as in the arrangement in FIG. 1 and the back wall reinforcing panel underlying the innermost back wall forming panel. In FIG. 8 the box 210 is provided with a wall reinforcing insert 215 which is in two identical parts 216 and 216'. Each of the two strip members 216 and 216' may be formed as described with respect to the insert 15 but with the end wall reinforcing panels being shortened to approximately half the length of the box end walls and the two strip members or parts 216 and 216' disposed so that the ends meet in the mid portion of the oppositely disposed end walls. In FIG. 9 box 310 is provided with an insert assembly 315 which is formed in two parts 316 and 316' with each of the two members 316 and 316' each in the form of an "L" and disposed in adhesive engagement with the inside faces of the outer wall forming panels of the box body, with the ends meeting at oppositely disposed corners of the box body and overlapped by the inner wall panels as described with respect to the boxes in FIGS. 7 and 8.

While the invention has been described with reference to a preferred embodiment, it will be understood by those skilled in the art that various changes may be made and equivalents may be substituted for elements thereof without departing from the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. A box in the form of a tray with a hinged lid which is adapted for the packaging of cigars or similar articles, said box being formed from a single cut and scored blank of relatively light weight paperboard, said box having a body portion comprising a rectangular bottom wall, front and back sidewalls and end walls which are upstanding from the peripheral edges of the bottom wall, and a planar lid hinged along one edge thereof to the top edge of the back wall, the front, back and end walls having outer and inner panels, the inner panels on the front and end walls each being folded downwardly from a top edge of the wall which top edge has substantial width and said inner panels being secured on the inside of said upstanding walls, the front and back wall forming outer panels having hinged corner connecting panels secured between the inner and outer panels of the end walls, and a reinforcing panel insert of substantial thickness secured between the inner and outer panels of said front and end walls, said hinged lid comprises an outer and inner panel of substantially the same size, and reinforcing panels hinged to the opposite end edges of one of said outer and inner panels and adhesively secured between said outer and inner panels so as to form a substantially rigid reinforced, planar lid structure.

2. A box as set forth in claim 1 wherein said back wall includes an inner panel which is hinged to the edge of the lid at the hinge connection of the lid with the back wall and which is free to slide on the inner face of the back wall when the lid is opened and closed.

3. A box as set forth in claim 1 wherein said reinforcing panel insert extends substantially the full depth of said front and end walls and said panel insert is adhesively secured in face to face relation to the oppositely disposed faces of said outer and inner panels of said front and end walls.

4. A box as set forth in claim 1 wherein said reinforcing panel insert extends along the inside faces of the outer panels of said upstanding front and back walls and said end walls and said insert is adhesively secured to the inside faces of front, back and end wall outer panels.

5. A box as set forth in claim 1 wherein said reinforcing panel insert is in two parts with one part extending along the inside faces of the front and one end wall and with the other one of said two parts extending along the inside faces of the back and the other end wall, the meeting end edges of the two parts being disposed at opposite corners of the box body portion.

6. A box as set forth in claim 1 wherein said reinforcing panel insert is in two parts which extend along the inside faces of the front, back and end walls with the meeting end edges of said two parts being disposed intermediate the ends of said end walls.

* * * * *